US006547604B2

(12) United States Patent
Arnett et al.

(10) Patent No.: US 6,547,604 B2
(45) Date of Patent: Apr. 15, 2003

(54) COMMUNICATION JACK CONNECTOR CONSTRUCTION FOR AVOIDING DAMAGE TO CONTACT WIRES

(75) Inventors: Jaime R. Arnett, Fishers, IN (US); Robert R. Goodrich, Indianapolis, IN (US); Paul J. Straub, Jr., Mooresville, IN (US); Ronald L. Wild, Carmel, IN (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 10/084,849

(22) Filed: Feb. 26, 2002

(65) Prior Publication Data

US 2002/0160662 A1 Oct. 31, 2002

Related U.S. Application Data

(63) Continuation-in-part of application No. 09/664,814, filed on Sep. 19, 2000, now Pat. No. 6,350,158.
(60) Provisional application No. 60/345,662, filed on Jan. 2, 2002.

(51) Int. Cl.[7] ..... H01R 24/00
(52) U.S. Cl. ..... 439/676
(58) Field of Search ..... 439/676, 344, 439/941, 76.1, 557, 188; 333/1

(56) References Cited

U.S. PATENT DOCUMENTS

| | | | | |
|---|---|---|---|---|
| 5,503,572 A | | 4/1996 | White et al. | 439/676 |
| 6,116,964 A | * | 9/2000 | Goodrich et al. | 439/676 |
| 6,155,881 A | | 12/2000 | Arnett et al. | 439/676 |
| 6,186,834 B1 | * | 2/2001 | Arnett et al. | 439/676 |
| 6,196,880 B1 | * | 3/2001 | Goddrich et al. | 439/676 |
| 6,290,546 B1 | | 9/2001 | Pharney | 439/676 |
| 6,350,158 B1 | * | 2/2002 | Arnett et al. | 439/676 |
| 6,364,694 B1 | * | 4/2002 | Lien | 439/489 |
| 6,428,362 B1 | * | 8/2002 | Phommachanh | 439/676 |

FOREIGN PATENT DOCUMENTS

| | | | |
|---|---|---|---|
| EP | 0 899 827 A | 3/1999 | H01R/23/02 |
| EP | 0 907 226 A2 | 4/1999 | H01R/23/02 |
| GB | 2 329 530 | 3/1999 | H01R/13/66 |

* cited by examiner

*Primary Examiner*—P. Austin Bradley
*Assistant Examiner*—Ross Gushi
(74) *Attorney, Agent, or Firm*—Thomas, Kayden, Horstemeyer & Risley, LLP

(57) ABSTRACT

A communication jack connector includes a wiring board having a front region, and a number of contact wires for engaging and making electrical connections with corresponding terminals of a conforming plug connector. The contact wires have free ends formed to be deflected resiliently in a direction toward the front region of the wiring board when engaging the plug connector. At least one clearance opening is formed in the wiring board at a location where the free end of a corresponding contact wire would otherwise contact an upper surface of the board when deflected by the plug connector. The clearance opening is dimensioned so that part of the free end of the contact wire deflects into the opening a certain distance from the upper surface of wiring board while the contact wire maintains sufficient resilient force to connect electrically with the corresponding terminal of the plug connector.

6 Claims, 7 Drawing Sheets

COMMUNICATION JACK CONNECTOR CONSTRUCTION FOR AVOIDING DAMAGE TO CONTACT WIRES

CROSS REFERENCE TO RELATED APPLICATIONS

This application is a continuation-in-part of U.S. application Ser. No. 09/664,814 filed Sep. 19, 2000, and due to issue as U.S. Pat. No. 6,350,158 on Feb. 26, 2002. This application also claims the priority under 35 U.S.C. §119(e) of U.S. Provisional Application 60/345,662 filed Jan. 2, 2002.

BACKGROUND OF THE INVENTION

1. Field of the Invention

This invention pertains to constructions for communication jack connectors.

2. Discussion of the Known Art

Modern office, laboratory and business environments typically employ both telephone and wired data communication networks (e.g., LANs). While telephone jacks are usually constructed to receive conventional 6-position modular telephone plugs carrying 4 or 6 wires (e.g., types "RJ-11" or "RJ-14"), data jacks are typically constructed to receive 8-position, modular communication plugs which carry 8 wires and conform with EIA/TIA standard 568B (type "RJ-45"). Because the telephone and the data jacks are frequently mounted next to one another, sometimes on a common faceplate or wall plate, it is not unusual for persons mistakenly to try to insert a non-conforming modular telephone plug into a modular data jack with damaging results. That is, a modular telephone plug can permanently deform the endmost contact wires (e.g., contact wires 1 and 8) of a data jack, since solid (ungrooved) side portions of the plug are wide enough to strike the end contact wires and deflect them beyond tolerable limits as the plug is forced into the jack.

SUMMARY OF THE INVENTION

According to the invention, a communication jack connector assembly includes a wiring board and a number of terminal contact wires extending above the board for engaging and making electrical connections with corresponding terminals of a plug connector along a line of contact, wherein the contact wires have free ends located ahead of the line of contact and the free ends are formed to be deflected resiliently in a direction toward the wiring board when engaging the plug connector. At least one clearance opening is formed in the wiring board at a position where the free end of a corresponding contact wire would otherwise contact an upper surface of the board when engaging the plug connector. The clearance opening is dimensioned so that part of the free end of the contact wire deflects into the opening a certain distance from the upper surface of wiring board, while the contact wire maintains sufficient resilient force to connect electrically with the corresponding terminal of the plug connector.

For a better understanding of the invention, reference is made to the following description taken in conjunction with the accompanying drawing and the appended claims.

DETAILED DESCRIPTION OF THE INVENTION

Figure 1:
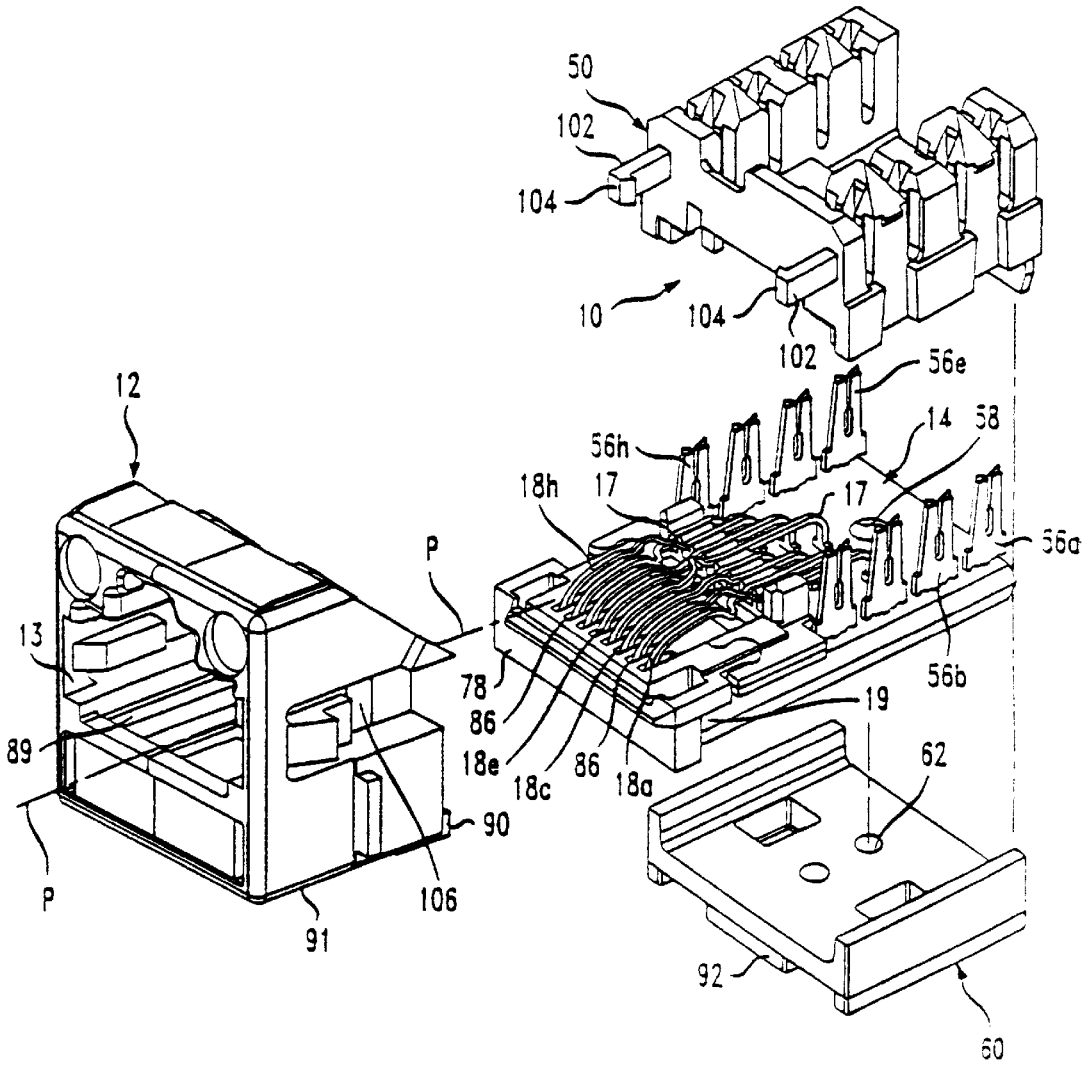
FIG. 1 is an assembly view of a communication jack connector.

FIG. 1 is an assembly view of a communication jack connector 10. The connector 10 includes a jack housing 12 having a front face in which a plug opening 13 is formed. The plug opening 13 has an axis P along the direction of which a mating plug connector 11 (see FIG. 5) is insertable into the jack housing.

The connector 10 also includes a generally rectangular printed wiring board 14. For example, the board 14 may comprise a single or a multi-layered dielectric substrate. A number of elongated terminal contact wires 18*a*–18*h* extend in a generally horizontal direction with respect to a top surface of the wiring board 14, and substantially parallel to one another. Connecting portions 17 of the contact wires are spaced a certain distance (e.g., 0.090 inches) from the top surface of the wiring board 14.

Figure 2:
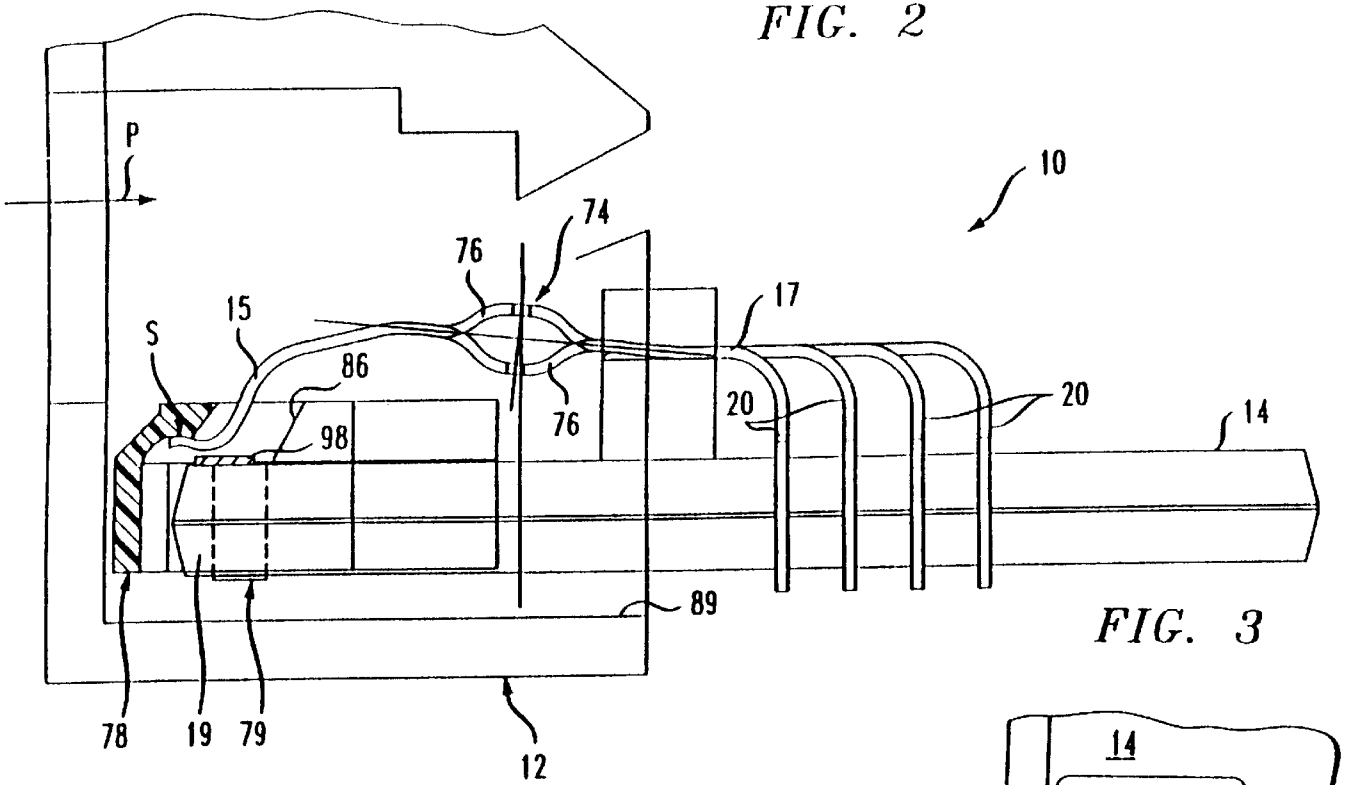
FIG. 2 is an enlarged, side view of a printed wiring board in the connector of FIG. 1, and contact wires on the board at a first position out of engagement with compensation coupling contacts at a front edge region of the board.

As seen in FIG. 2, free ends 15 of the connecting portions 17 curve downward toward a front edge region 19 of the wiring board 14. The free ends 15 are formed to deflect resiliently in the direction of the front edge region 19 of the board when blade contacts 21 of the plug connector 11 wipe over corresponding contact wires of the connector 10 in a direction parallel to the top surface of the board 14 (i.e., along the axis P). See FIG. 5. The contact wires 18*a*–18*h* may be formed of a copper alloy such as spring-tempered phosphor bronze, beryllium copper, or the like. A typical cross-section for the contact wires is 0.015 inch wide by 0.010 inch thick.

The connector contact wires 18*a*–18*h* have associated base portions 20 opposite their free ends 15. Each base portion 20 is formed to connect a contact wire to one or more conductors (not shown) on or within the wiring board 14. For example, the base portions 20 may be soldered or press-fit in plated terminal openings formed in the board, to connect with corresponding conductive paths on or within the board. As shown in the drawing, the base portions 20 project in a generally normal direction with respect to the top surface of the wiring board 14.

In the disclosed embodiment, the base portions 20 are shown as entering the wiring board 14 with a "duo-diagonal" footprint pattern. Alternatively, the base portions may enter the wiring board with other footprints, e.g., a "saw tooth" pattern, as long as there is a sufficient distance between the plated openings in which the base portions are received to avoid electrical arcing, per industry requirements.

The wiring board 14 may incorporate electrical circuit components or devices arranged, for example, on or within a rear portion of the board to compensate for connector-induced crosstalk. Such devices include but are not limited to wire traces printed on or within layers of the board 14. See, e.g., U.S. Pat. No. 5,997,358 (Dec. 7, 1999).

An electrically insulative, rigid dielectric terminal housing 50 (FIG. 1) covers a rear portion of the wiring board 14. Outside insulated wire leads may be connected to insulation displacing connection (IDC) terminals 56*a* to 56*h* on the board, which terminals are only partly surrounded by housing terminal guards. The housing 50 is formed of a rigid plastics or other insulative material that meets all applicable standards with respect to electrical insulation and flammability. Such materials include but are not limited to polycarbonate, ABS, and blends thereof. The housing 50 has, for example, at least one fastening or mounting post (not shown) that projects from a bottom surface of the housing to pass through one or more openings 58 formed to coincide with the long axis of board 14.

Terminals 56*a*–56*h* are mounted along both sides of the rear portion of the wiring board 14, as seen in FIG. 1. Each of the terminals 56*a*–56*h* has a mounting portion that is soldered or press fit in a corresponding terminal mounting hole in the board, to connect via a conductive path or trace (not shown) with a corresponding one of the terminal contact wires 18*a*–18*h*. When the terminal housing 50 is aligned above the IDC terminals 56*a*–56*h* and then lowered to receive the terminals in corresponding slots in the terminal guards, a fastening post of the housing 50 aligns with and passes through an opening 58 in the board 14.

A cover 60 is formed of the same or a similar material as the terminal housing 50. The cover 60 is arranged to protect the rear portion of the wiring board 14 from below. Cover 60 has at least one opening 62 which aligns with a tip of a fastening post of the housing 50, below the opening 58 in the wiring board. The board is thus captured and secured between the terminal housing 50 and the cover 60, and the tip of the fastening post is joined to the body of the cover 60 by, e.g., ultrasonic welding, so that the rear portion of the wiring board is protectively enclosed. See U.S. Pat. No. 5,924,896 (Jul. 20, 1999).

Figure 4:
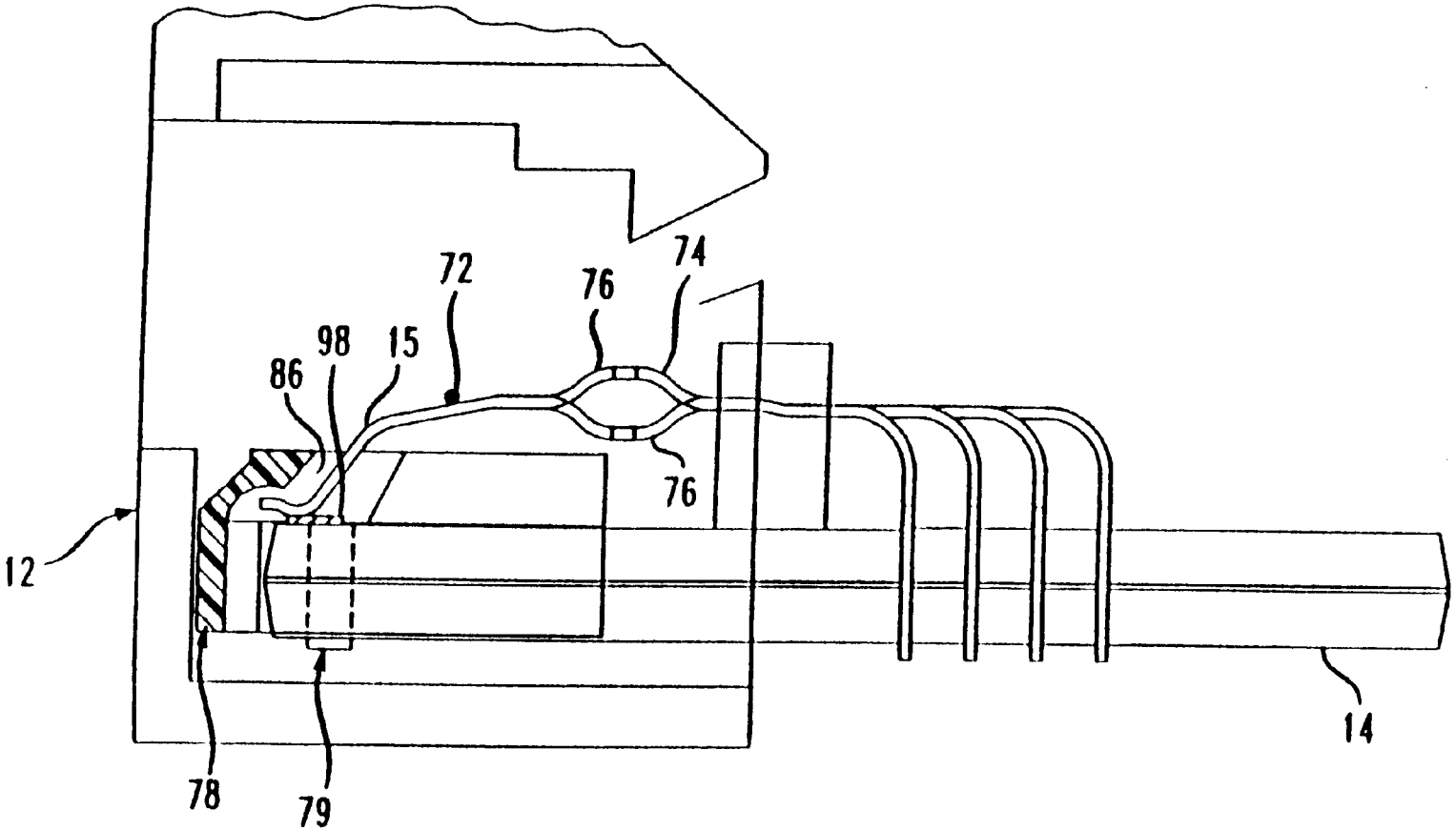
FIG. 4 is a side view as in FIG. 2, showing the contact wires at a second position in engagement with the compensation coupling contacts at the front of the wiring board.
Figure 5:
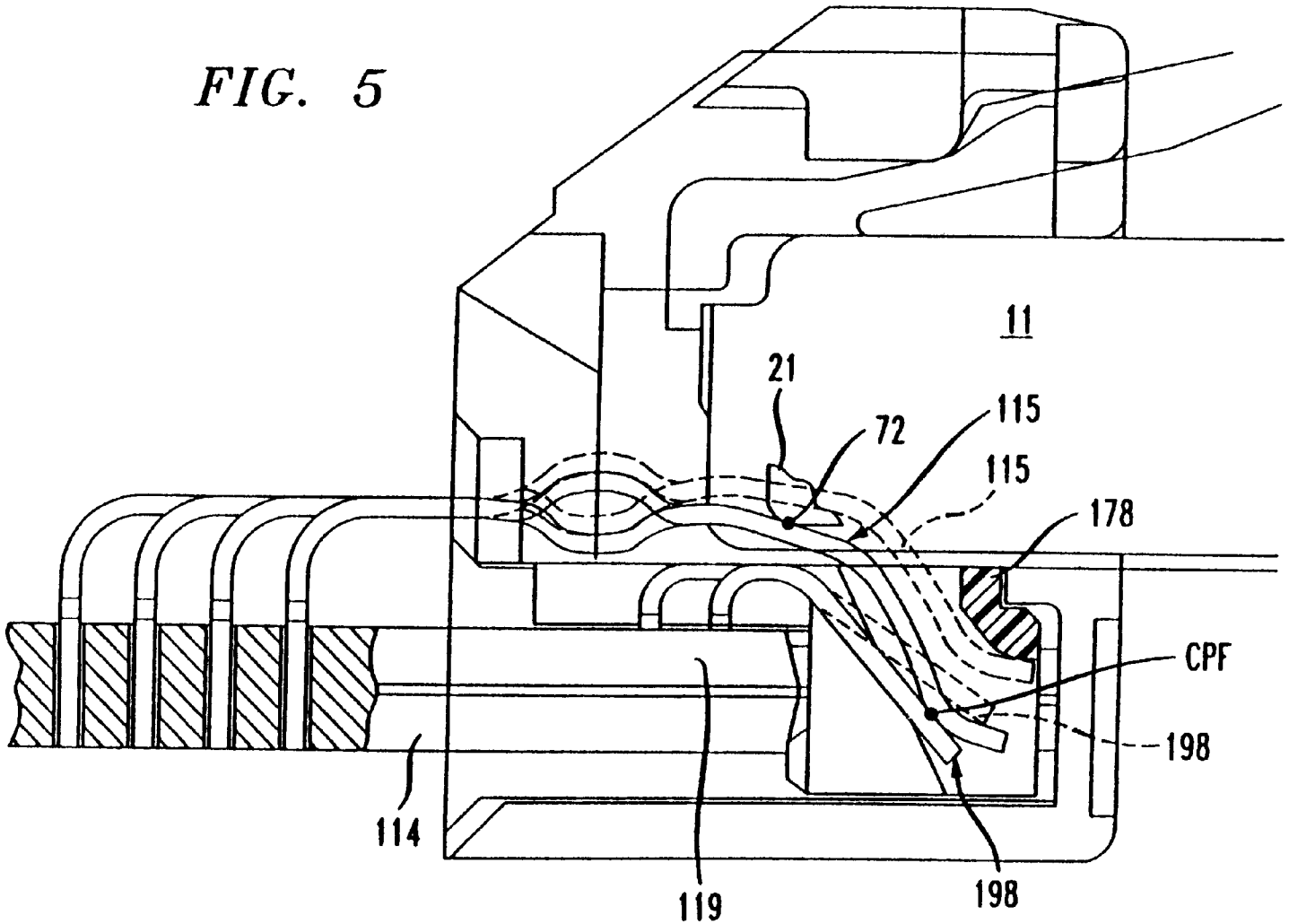
FIG. 5 is a side view of a second embodiment of a communication jack connector.

The connecting portions 17 of the terminal contact wires, between the base portions 20 and the free ends 15 of the wires, are formed to make electrical contact with corresponding blade contacts 21 of the plug connector 11 (see, e.g., FIG. 5). A line of contact 72 (see FIGS. 4 & 5) is defined transversely of the contact wires, along which electrical connections are established between the connector 10 and the blade contacts 21 of the plug connector 11. As mentioned, when the plug connector 11 is inserted in the opening 13 of the jack housing 12, the free ends 15 of contact wires 18*a*–18*h* are deflected in unison and resiliently toward the front edge region 19 of wiring board 14.

Certain pairs of the terminal contact wires have cross-over sections 74 at which one contact wire of a pair is stepped toward and crosses over the other contact wire of the pair, with a generally "S"-shaped side-wise step 76. As seen in FIGS. 2 and 4, the terminal contact wires curve arcuately above and below their common plane at each cross-over section 74. Opposing faces of the steps 76 in the contact wires are typically spaced by about 0.040 inches, i.e., enough to prevent short circuiting when the contact wires are engaged by the mating connector 11. The cross-over sections 74 are relatively close to the line of contact 72, and serve to allow inductive crosstalk compensation coupling to be induced among parallel portions of the terminal contact wires in a region between the cross-over sections 74 and the base portions 20 of the contact wires.

A terminal wire guide block 78 is mounted on the front edge region 19 of the wiring board 14, as shown in FIGS. 1, 2 and 4. The guide block 78 has equi-spaced vertical guide ways 86. The free ends 15 of the terminal contact wires extend within corresponding ones of the guide ways, and are guided individually for vertical movement when deflected by the blade contacts 21 of the plug connector 11, as in FIG. 4. Each guide way 86 is, e.g., 0.020 inch wide, and adjacent ones of the guide ways are separated by 0.020 inch thick walls. The guide block 78 may also have, e.g., ribbed mounting posts 79 that project downward to register with corresponding mounting holes in the wiring board 14 to establish a press-fit.

When in the undeflected position of FIG. 2, the free ends 15 of the terminal contact wires abut an upper inside surface of each guideway 86. A determined pre-load force is thus established, which force must then be applied by the blade contacts 21 of the plug connector 11 as the blade contacts wipe against and urge the free ends 15 of the contact wires downward to the position of FIG. 4.

As they deflect downward, the free ends 15 of the contact wires themselves establish a wiping contact against corresponding compensation coupling contacts in the form of conductive contact pads 98. See FIGS. 2 & 3. The pads 98 are arrayed in a row parallel to and near the front edge of the wiring board 14, and are spaced apart from one another by a distance corresponding to a spacing between the free ends 15 of the terminal contact wires. The guideways 86 of the block 78 serve to keep the free ends 15 aligned and centered with corresponding ones of the contact pads 98 on the wiring board.

The contact pads 98 are connected by conductive paths to, e.g., capacitive crosstalk compensation elements on or within the wiring board 14. Accordingly, when the terminal contact wires 18*a*–18*h* are engaged by a mating connector, certain pairs of contact wires will be capacitively coupled to one another by compensation elements connected to the corresponding contact pads 98. Note that the free ends 15 are ahead of and near the line of contact 72 with the mating connector. Crosstalk compensation coupling is thus introduced onto non-current carrying portions of the contact wires, and operates at the connector interface (i.e., the line of contact 72) where such coupling can be most effective.

Figure 3:
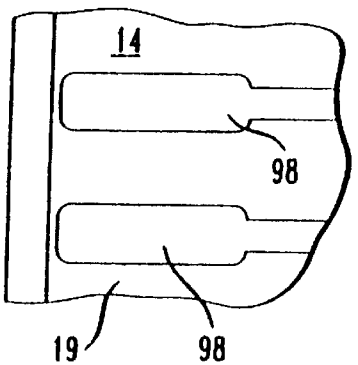
FIG. 3 is an enlarged plan view of two compensation coupling contacts in the form of pads at the front edge region of the wiring board in FIG. 2.

FIG. 3 is an enlarged view of two adjacent contact pads 98. Each pad is typically, e.g., 0.018 inches wide, and side edges of the pads are typically spaced apart from one another by, e.g., 0.022 inches to meet a specified 1000 volt breakdown requirement. Corners of the contact pads 98 are preferably rounded with a radius of, e.g., 0.004 inches.

Crosstalk compensation elements or devices that are coupled to the contact pads 98 are provided in a region 100 on or within the wiring board 14, in the vicinity of the pads 98 at the front edge region 19 of the wiring board 14. See FIG. 9. Compensation elements within the region 100 preferably are not part of any other capacitive or inductive compensation circuitry that may be incorporated at other portions (e.g., toward the rear) of the board 14. Placing the compensation elements close to the associated contact pads 98 enhances the effect of such elements at the connector interface.

The wiring board 14 including the front edge region 19 with the array of contact pads 98, may be supported within space available in existing jack frames such as, e.g., jack frames provided for the types "MGS 300" and "MGS 400" series of modular connectors available from Avaya Inc.

The wiring board 14 with the guide block 78 mounted at front edge region 19, is inserted in a passage 89 that opens in a rear wall of the jack housing 12. See FIGS. 1 & 2. Side edges of the board 14 are guided for entry into the housing 12 by, e.g., flanges that project from inside walls of the jack housing 12. The jack housing has a slotted catch bar 90 (FIG. 1) protruding rearwardly from a bottom wall 91 of the housing. The bar 90 is arranged to capture a lip 92 that projects downward beneath the wiring board cover 60. When the wiring board 14 is secured in the jack housing 12, the top surface of the board is parallel to the plug opening axis P along the direction of which the plug connector 11 may engage and disengage the free ends 15 of the contact wires 18*a*–18*h*.

Further, in the present embodiment, two side catches 102 project forward from both sides of the terminal housing 50, and the catches 102 have hooked ends 104 that snap into and lock within recesses 106 formed in both side walls of the jack housing 12. Thus, all adjoining parts of the connector 10 are positively joined to one another to reduce movement between them, and to maintain rated connector performance by reducing variation in relative positions of the connector parts when finally assembled.

Figure 6:
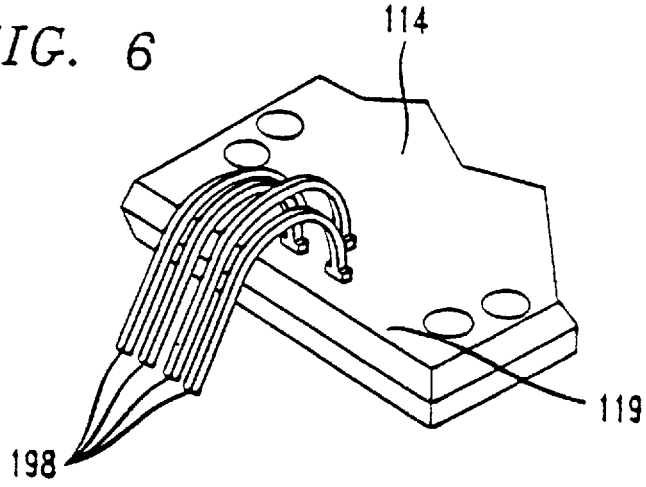
FIG. 6 is a perspective view of a front edge region of a wiring board in the embodiment of FIG. 5, showing compensation coupling contacts in the form of stiff wires mounted on the board.

FIGS. 5 and 6 show a front edge region 119 of a wiring board 114 in a second embodiment of a connector assembly. In the second embodiment, free ends 115 of the terminal contact wires project forwardly beyond the front edge region 119 of the board 114. A number of arcuate, stiff wire contacts 198 are mounted at the front edge region 119, and are aligned beneath corresponding free ends 115 of the contact wires.

FIG. 5 shows, in dotted lines, the position of the free ends 115 of the terminal contact wires in a pre-loaded state, resting against upper ledges in the guide ways of a guide block 178 mounted on the wiring board 114. FIG. 5 also shows an initial position of the contacts 198 in dashed lines. When the mating plug connector 11 is received in the jack frame, the free ends 115 of the terminal contact wires deflect resiliently downward. The wire contacts 198 mounted on the board are then engaged by the free ends of those terminal contact wires aligned above them, as shown in solid lines in FIG. 5. Like the first embodiment, this arrangement introduces crosstalk compensation coupling via associated compensation elements disposed on or within the wiring board 114, near the wire contacts 198.

Figure 7:
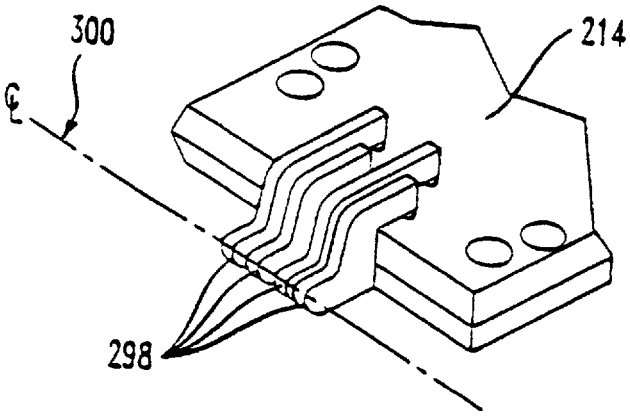
FIG. 7 is a perspective view of a front edge region of a wiring board in a third embodiment of a communication jack connector, showing compensation coupling contacts in the form of metal plates mounted on the wiring board.
Figure 8:
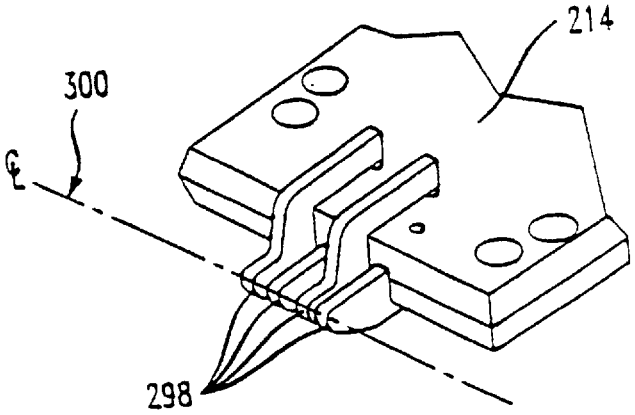
FIG. 8 shows an alternate arrangement of the metal plate contacts on the wire board in FIG. 7.

FIGS. 7 and 8 show a third embodiment wherein compensation coupling contacts 298 are in the form of non-compliant conductive members, e.g., stamped metal plates. The metal plates may have, for example, compliant "needle-eye" mounting bases (not shown) dimensioned and formed to be press-fit into corresponding plated terminal openings in an associated wiring board 214. As the free ends of the terminal contact wires deflect downward, they make contact with corresponding ones of the metal plates along a contact line 300. FIG. 8 shows an arrangement wherein the mounting bases of adjacent metal plates 298 enter the wiring board 214 from opposite sides of the board, thus reducing potential offending crosstalk that might otherwise be induced among the plates 298.

Figure 9:
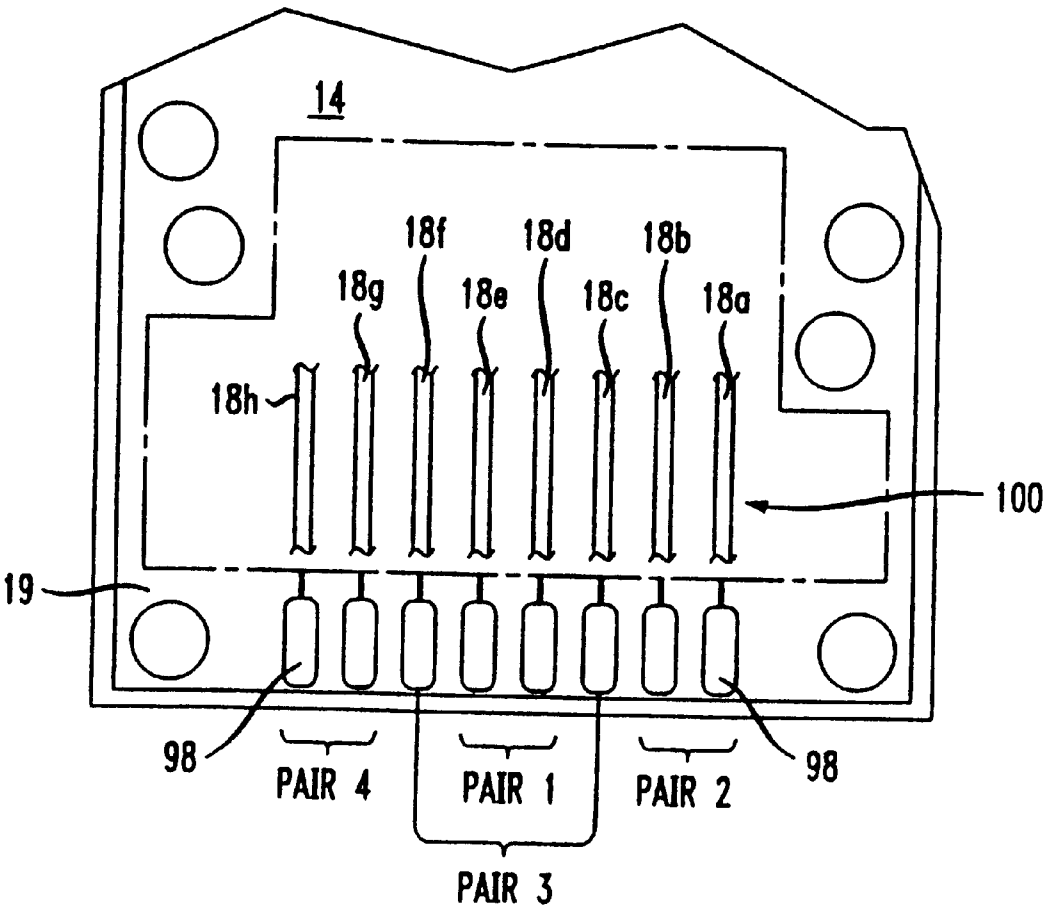
FIG. 9 is a plan view of the front edge region of the wiring board in the embodiment of FIGS. 1–4.

FIG. 9 is a view of the front edge region 19 of the wiring board 14 in the embodiment of FIGS. 1–4, showing eight contact pads 98. Each of the pads is disposed on the board 14 in operative relation beneath a free end of an associated terminal contact wire (not shown). Capacitive compensation coupling was introduced between pairs of the pads by way of wire traces or elements embedded within the region 100 on the board 14, as detailed later below. The rightmost pad 98 in FIG. 9 is associated with contact wire 18*a* in FIG. 1, and the leftmost pad in the figure is associated with contact wire 18*h*. Four pairs of the eight contact wires define four different signal paths in the connector 10, and the signal-carrying pairs of contact wires are identified by number as follows with reference to FIG. 9.

| PAIR NO. | CONTACT WIRES |
|---|---|
| 1 | 18d and 18e |
| 2 | 18a and 18b |
| 3 | 18c and 18f |
| 4 | 18g and 18h |

Values of capacitive compensation coupling introduced via the pads 98 associated with the contact wires, were as follows.

| Pads 98 associated with contact wires | Capacitance (picofarads) between pads |
|---|---|
| 18a and 18c | 0.04 |
| 18a and 18d | 0.04 |
| 18b and 18e | 0.09 |
| 18b and 18f | 0.42 |
| 18c and 18e | 1.25 |
| 18d and 18f | 1.25 |

NEXT measurements were performed with the above values of capacitive coupling introduced via the pads 98 between the free ends of the contact wires. Some crosstalk compensation was also provided in a region of the wiring board 14 outside the region 100. Category 6 performance was met or exceeded among all four signal-carrying pairs of the contact wires in the connector 10.

Figure 10:
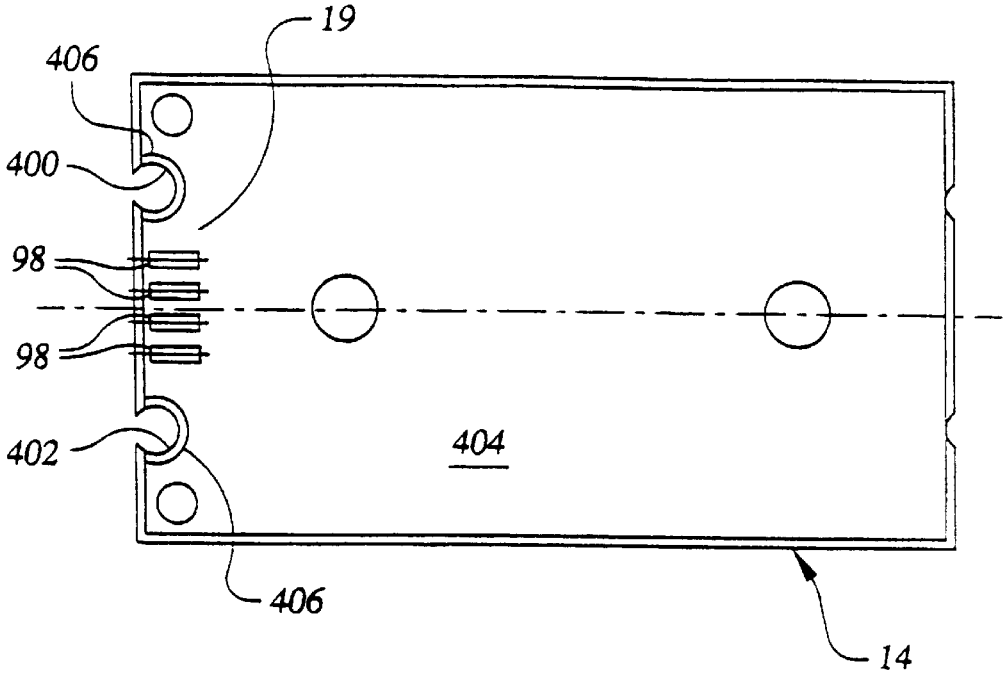
FIG. 10 is a plan view of a printed wiring board constructed according to the invention.
Figure 11:
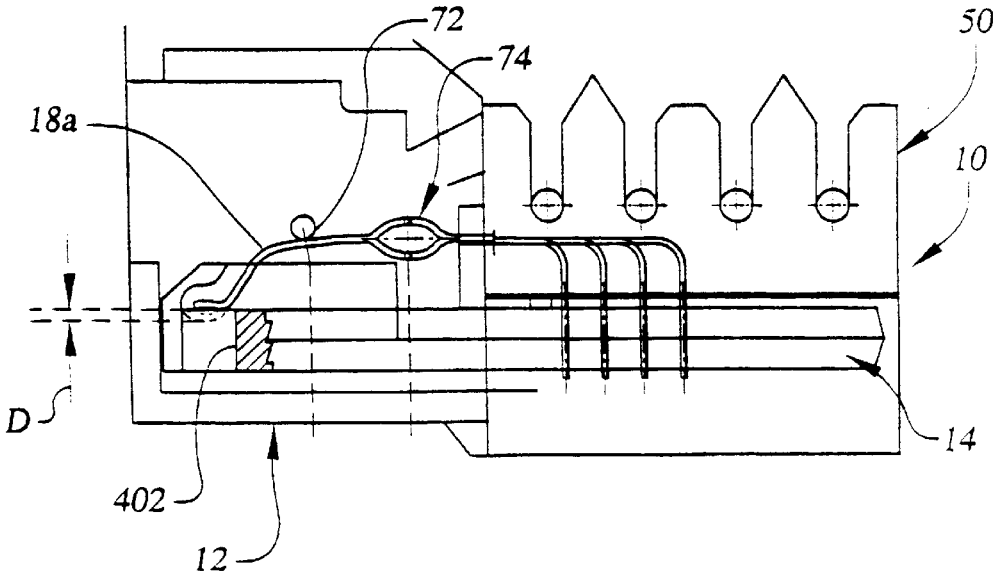
FIG. 11 is a side view of a communication jack connector including the wiring board of FIG. 10.

FIGS. 10 and 11 show a construction according to the invention for avoiding damage to outermost terminal contact wires, e.g., contact wires 18*a* and 18*h* in the embodiment of FIGS. 1–4, under certain conditions. As mentioned earlier, the outermost contact wires may be permanently deformed and rendered inoperative when an attempt is made to force a conventional six position, 4- or 6-wire telephone plug into an eight position jack such as the jack connector 10 of FIGS. 1–4. Because data jacks are commonly mounted immediately adjacent to telephone jacks, mistaken attempts to insert telephone plugs into data jacks, with consequent damaging results, are quite common.

Conventional six position modular telephone plugs have continuous outer end surfaces at those positions where recesses are formed in an eight position data plug for receiving the leading ends of the outermost jack contact wires, e.g., wires 18*a* and 18*h* in FIG. 1. The continuous end surfaces on the telephone plugs extend about 0.023 inch above recessed contact blades in the plugs, and will therefore cause the leading ends of the outermost jack contact wires to deflect at least 0.023 inch farther than normal and thus deform permanently. Such over-deflection may also result in a reduced contact force between the outermost jack contact wires and the corresponding contact blades of a conforming data plug (typically 100 grams) to unsafe levels if the conforming plug is later inserted in the jack.

As seen in FIGS. 10 and 11, two breakout or clearance openings 400, 402 are formed in the front edge region 19 of the printed wiring board 14, where leading or free ends of the terminal contact wires 18*a* and 18*h* would otherwise physically touch the board when deflected by an inserted plug connector. The openings 400, 402 are located and configured so that the free ends of the contact wires 18*a*, 18*h* may enter the openings and be allowed to deflect below the level of the top surface 404 of the wiring board 14 by a distance D (FIG. 11) of about 0.018 inch in response to insertion of either a conforming eight position data plug, or a non-conforming six position telephone plug. By limiting the additional range of movement to 0.018 inch, major over-stressing of the outermost contact wires is prevented while sufficient resilient force is left available for the contact wires to connect electrically with the corresponding blade terminals on a conforming plug connector.

Walls of the breakout openings 400, 402 may also be plated as at 406 in FIG. 10, to allow components on or within the wiring board 14 to connect electrically with the free ends of the outermost contact wires for purposes of, e.g., crosstalk compensation. In such a case, the breakout openings 400, 402 should be located and formed so that in addition to averting overstressed conditions of the outermost contact wires, the leading ends of those wires will be urged against the plated walls of the openings with sufficient force to establish reliable electrical connections when the contact wires are deflected by a conforming plug connector.

While the foregoing description represents preferred embodiments of the invention, it will be obvious to those skilled in the art that various changes and modifications may be made, without departing from the spirit and scope of the invention pointed out by the following claims.

We claim:

1. A communication jack connector assembly, comprising:

a wiring board having a front region; and a number of elongated terminal contact wires extending above the wiring board for engaging and making electrical connections with corresponding terminals of a conforming plug connector along a line of contact, wherein the terminal contact wires have free ends located ahead of said line of contact, and the free ends are formed to be deflected resiliently in a direction toward the front region of the wiring board when engaging the plug connector;

wherein at least one clearance opening is formed in the front region of the wiring board at a position where the free end of a corresponding contact wire would otherwise contact an upper surface of the board when engaging the plug connector, and the clearance opening is dimensioned so that part of the free end of the corresponding contact wire deflects into the clearance opening a certain distance from the upper surface of wiring board while the contact wire maintains sufficient resilient force to connect electrically with the corresponding terminal of the plug connector.

2. A jack connector assembly according to claim 1, wherein the two clearance openings are formed at positions on the wiring board to correspond with two outside terminal contact wires.

3. A jack connector assembly according to claim 1, wherein said certain distance is sufficient to prevent the corresponding contact wire from being permanently deformed when deflected by a non-conforming plug connector.

4. A communication jack connector, comprising:

a jack housing having a plug opening, the plug opening having an axis and the housing being constructed and arranged for receiving a conforming plug connector in the plug opening along the direction of the plug axis; and a communication connector assembly supported within the jack housing, for electrically contacting said conforming plug connector when the plug connector is received in the jack housing, the connector assembly including:

a wiring board having a front region; and a number of elongated terminal contact wires extending above the wiring board for engaging and making electrical connections with corresponding terminals of the conforming plug connector along a line of contact, wherein the terminal contact wires have free ends located ahead of said line of contact, and the free ends are formed to be deflected resiliently in a direction toward the front region of the wiring board when engaging the plug connector;

wherein at least one clearance opening is formed in the front region of the wiring board at a position where the free end of a corresponding contact wire would otherwise contact an upper surface of the board when engaging the plug connector, and the clearance opening is dimensioned so that part of the free end of the corresponding contact wire deflects into the clearance opening a certain distance from the upper surface of the wiring board while the contact wire maintains sufficient resilient force to connect electrically with the corresponding terminal of the plug connector.

5. A jack connector according to claim 4, wherein the two clearance openings are formed at positions on the wiring board to correspond with two outside terminal contact wires.

6. A jack connector according to claim 4, wherein said certain distance is sufficient to prevent the corresponding contact wire from being permanently deformed when deflected by a non-conforming plug connector inserted in the plug opening of the jack housing.

* * * * *